United States Patent [19]

Hays

[11] 4,368,970

[45] Jan. 18, 1983

[54] DEVELOPMENT PROCESS AND APPARATUS

[75] Inventor: Dan A. Hays, Fairport, N.Y.

[73] Assignee: Xerox Corporation, Stamford, Conn.

[21] Appl. No.: 304,528

[22] Filed: Sep. 21, 1981

Related U.S. Application Data

[63] Continuation-in-part of Ser. No. 155,804, Jun. 2, 1980, abandoned.

[51] Int. Cl.[3] ..... G03G 15/08

[52] U.S. Cl. ..... 355/3 DD; 355/14 D; 355/16; 355/3 BE; 118/649; 118/657; 118/658; 430/122

[58] Field of Search ..... 355/3 DD, 14 D, 16, 355/3 BE; 118/656, 651, 649, 657, 658; 430/122

[56] References Cited

U.S. PATENT DOCUMENTS

| | | | |
|---|---|---|---|
| 3,900,001 | 8/1975 | Fraser et al. | 118/637 |
| 3,970,571 | 7/1976 | Olson et al. | 252/62.1 |
| 4,013,041 | 3/1977 | Armstrong et al. | 118/637 |
| 4,076,857 | 2/1978 | Kasper et al. | 427/18 |
| 4,081,571 | 3/1978 | Nishihama et al. | 427/18 |
| 4,096,826 | 6/1978 | Stange | 355/3 DD |
| 4,121,931 | 10/1978 | Nelson | 96/1 SD |
| 4,121,931 | 10/1978 | Nelson | 96/1 SD |
| 4,154,520 | 5/1979 | Nishikawa et al. | 355/3 D |
| 4,206,994 | 6/1980 | Silverberg et al. | 355/3 BE X |
| 4,210,397 | 7/1980 | Macaluso et al. | 355/3 DD X |
| 4,264,182 | 4/1981 | Mitchell | 118/657 X |
| 4,264,201 | 4/1981 | Stahl | 355/16 X |

*Primary Examiner*—A. C. Prescott

*Attorney, Agent, or Firm*—E. O. Palazzo

[57] ABSTRACT

The present invention is directed to an electrostatographic imaging apparatus, and an electrostatographic imaging method utilizing such apparatus, wherein the apparatus is comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating toner particles, and electrically insulating magnetic carrier particles, means for causing the flexible imaging means for causing the transporting member to move at a speed of from about 5 cm/sec, to about 50 cm/sec; means to move at a speed of from about 6 cm/sec to about 100 cm/sec, the means for imaging and the means for transporting moving at different speeds; and the means for imaging and the means for transporting having a distance therebetween of from about 0.05 millimeters to about 1.5 millimeters.

25 Claims, 11 Drawing Figures

DEVELOPMENT PROCESS AND APPARATUS

This application is a continuation-in-part of U.S. Ser. No. 155,804, filed on June 2, 1980 now abandoned on Self Agitated Development Process.

BACKGROUND OF THE INVENTION

This invention generally relates to a process, and an apparatus for causing the development of images in electrostatographic systems. More specifically, the present invention is directed to an improved process, and an improved apparatus for accomplishing the development of electrostatic latent images, by providing a development zone encompassed by a moving deflected flexible imaging member, and a moving transporting member. The flexible imaging member is deflected by electrically insulating developer particles, comprised of insulating toner particles, and insulating magnetic carrier particles contained in the development zone, which deflection, together with the relative movement of said members, is primarily responsible for the agitation and movement of the developer particles. Such as process, and apparatus allows the continual development of high quality images, including the efficient and effective development of solid areas.

The development of images by electrostatographic means is well known. Generally in these systems, toner particles are applied to an electrostatic latent image by various methods including cascade development, reference U.S. Pat. No. 3,618,552, magnetic brush development, reference U.S. Pat. Nos. 2,874,063, 3,251,706, and 3,357,402, powder cloud development, reference U.S. Pat. No. 2,217,776, and touchdown development, reference U.S. Pat. No. 3,166,432. Cascade development and powder cloud development methods have been found to be especially well suited for the development of line images common to business documents, however, images containing solid areas are not faithfully reproduced by these methods. Magnetic brush development systems, however, provided an improved method for reproducing both line images, and solid areas.

In magnetic brush development systems, it is usually desirable to attempt to regulate the thickness of the developer composition, which is transported on a roller, by moving the roller past a metering blade. The adjustment of the metering blade is important, since in the development zone the flow of developer material is determined by a narrow restrictive opening situated between the transport roller and the imaging surface. Accordingly, in order to provide sufficient toner particles to the imaging surface, it is generally necessary to compress the developer bristles, thereby allowing toner particles adhering to the carrier particles near the ends of the bristle to be available for development. Any variation, or non-uniformity in the amount of developer metered onto the transport roller, or into the spacing between the transport roller and imaging member can result in undesired developer flow, and non-uniform image development. Non-uniform development is usually minimized by carefully controlling developer runout on the transport roller, and on the imaging member, and by providing a means for side-to-side adjustment in the relative positions of the metering blade, development roller and imaging member.

Moderate solid area development with magnetic brush is usually achieved by transporting the developer composition on a roller at a speed that exceeds the process speed of the image bearing member. At high process speeds the development-transport roller speed is limited by centrifugal forces, which forces cause the developer material to be removed from the roller. Thus, in order to obtain moderate solid area development at high process speeds, the use of multiple development rolls is necessary for increased developability.

The developer materials presently used in magnetic brush development differ widely in their electrical conductivity, thus at one extreme in conductivity, such materials can be insulating, in that a low electrical current is measured when a voltage is applied across the developer. Solid area development with insulating developer compositions is accomplished by metering a thin layer of developer onto a development roll, which is in close proximity to an image bearing member, the development roll functioning as an electrode, and thus increasing the electrostatic force acting on the toner particles. In these systems, the spacing between the image bearing member, and the development roller must be controlled to ensure proper developer flow, and uniform solid area development, the minimum average spacing generally being typically greater than 1.5 millimeters.

Insulating developer compositions can be rendered conductive by utilizing a magnetic carrier material which supports a high electric current flow in response to an applied potential. Generally, the conductivity of developer compositions depends on a number of factors including the conductivity properties of the magnetic carrier, the concentration of the toner particles, the magnetic field strength, the spacing between the image bearing member and the development roll, and developer degradation due to toner smearing on the carrier particles. Also, when insulative toner particles are permanently bonded to a conductive carrier, the conductivity decreases to a critical value below which solid area development becomes inadequate, however, within certain limits the process and material parameters can be adjusted somewhat to recover the decrease in solid area developability.

When employing conductive developer materials in electrostatographic imaging systems, the development electrode member is maintained at a close effective distance from the image bearing member, and a high electrostatic force acts only on those toner particles which are adjacent to the image bearing member. Accordingly, since the electrostatic force for development in such systems is not strongly dependent on the developer layer thickness, the uniformity of solid area development is improved despite variations in the spacing between the image bearing member and the development roller member. More specifically, for example, in magnetic brush development systems utilizing conductive developer materials, solid area deposition is not limited by a layer of net-charged developer near the imging member, since this charge is dissipated by conduction to a development roller. The solid area deposition is, however, limited by image field neutralization; provided there is sufficient toner available at the ends of the developer brush, which toner supply is limited to the ends or tips of the bristles, since toner cannot be extracted from the bulk of the developer mixture; wherein high developer conductivity collapses the electric field within the developer at any location, and confines it to a region between the latent image and the developer. For either insulative or conductive developer, solid area deposition is limited by toner supply at low toner concentrations, and the toner supply is limited to a layer of carrier material adjacent to the image bearing member, since the magnetic field stiffens the developer, and hinders developer mixing in the development zone.

In the above-described systems, undesirable degradation or deterioration of the developer particles results. This is generally caused by a variety of factors, including for example, the frequency of collisions between adjacent carrier particles contained in the developer composition, which collisions adversely affect the developer conductivity, and the triboelectric charging relationships between the toner particles and magnetic carrier particles. Thus, for example, a decrease in the triboelectric charge on the toner particles causes an increase in solid area development, and an increase in the amount of toner particles that are deposited in the background, or normally white areas of the image, accordingly, in order to maintain the original image quality in such situations, the triboelectric charge on the toner particles is increased, by reducing the concentration of such particles in the developer composition mixture. Also, when the toner charge, and toner concentration decreases, the developer material must be replaced in order to obtain images with acceptable solid areas and decreased background.

While several improved types of toner and carrier materials, as well as processes have been developed for the purposes of developing images, difficulties continue to be encountered in the design of a simple, inexpensive, and reliable two-component development system which will provide a high solid area development rate, low background deposition, and long term stability. The present magnetic brush systems are inherently inefficient primarily since only a small fraction of the toner transported through the development zone is accessible for deposition onto the image bearing member. For insulative developer, the solid area deposition is limited by a layer of net-charged carrier particles produced by toner development onto a precharged imaging member. Since the developer entering the development zone has a neutral charge, deposition of charged toner onto the imaging member produces a layer of oppositely charged developer which opposes further toner deposition. Also, the net electrostatic force due to the charged image member, and the net-charged developer layer becomes zero for that toner between the developer and the electrostatic latent image of the imaging member, and a collapse in the electrostatic force, or the electric field acting on the charged toner, occurs even though the toner charge deposited on the photoreceptor does not neutralize the image charge. Image field neutralization can occur, however, if there is a sufficiently high developer flow rate, and multiple development rollers. Image field neutralization results when the potential due to a layer of charged toner deposited on the imaging member is equal but opposite to the potential due to the charged imaging member. In the absence of a bias on the development roller, image neutralization produces a zero development electric field, and since the toner layer is of finite thickness, the charge density of the toner layer is less than the image charge density. Should the thickness of the charged toner layer be much less than the imaging member, image field neutralization occurs when the toner charge density neutralizes the image charge density.

Accordingly, there continues to be a need for apparatus and processes which will improve the quality of the images produced, particularly in electrostatographic systems, such as xerographic imaging systems, which are simple and economical to operate; and which result in reproducible high quality images, including both line copy and solid area image development. Additionally, there continues to be a need for the provision of an apparatus, and process wherein background development is substantially eliminated, and where the life of the developer composition is increased.

SUMMARY OF THE INVENTION

It is therefore a feature of the present invention to provide a development process, and development apparatus which overcomes the above-noted disadvantages.

It is a further feature of this invention to provide a self-agitated development apparatus, and process which allows for the production of images of high quality.

Another feature of the present invention is the provision of an improved development apparatus, and process, which employs two-component insulative developer materials, and a deflected flexible imaging member.

A further feature of the present invention is the provision of a self-agitated, two-component insulative development system, wherein low magnetic field development is accomplished.

An additional feature of the present invention is the provision of a self-agitated development apparatus and process, whereby toner particles are continuously available immediately adjacent to the imaging surface, thus allowing full development of the image involved, including development of all solid areas.

It is yet another feature of this invention to provide a development process for efficiently developing a low voltage image bearing member.

In a further feature of the present invention there is provided development apparatus, and process which extends the life of the developer.

These and other features of the present invention are accomplished by providing a self-agitated, two-component, insulative development process, and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member, into close proximity, that is, a distance of from about 0.05 millimeters to about 1.5 millimeters, and preferably from about 0.4 millimeters to about 1.0 millimeters, in the presence of a high electric field, and causing such members to move at relative speeds. Agitation of the developer particles contained in the development zone, depends primarily on the arc of degree of deflection of the flexible imaging member, and the relative speeds of, and the distance between the flexible imaging member and the transporting member, while migration of the toner particles depends primarily on the magnitude of the electric field in the development zone. The electric field utilized is inversely proportional to the developer thickness, and directly proportional to the difference in potential between the deflected charged imaging member, and the bias on the transporting member. At a typical image potential of about 400 volts, a background potential of about 50 volts, and a transporting member bias of about 100 volts to suppress background deposition, the solid area development potential is about 300 volts across the developer layer. For a preferred developer thickness of 0.5 mm (millimeters), the development electric field is 300 volts across 0.5 mm; i.e., 600 V/mm.

The degree of developer agitation is proportional to the shear rate, and the development time, thus, at a particular process speed and at a particular transporting member speed, increased developer agitation is obtained when the developer layer is thin, and the development zone is long. The development zone length ranges from 0.5 cm to 5 cm with a preferred length being between 1 cm and 2 cm. However, lengths outside these ranges may be used providing the objectives of the present invention are accomplished.

More specifically, the present invention in one embodiment is directed to a process for causing the development of electrostatic latent images on an imaging member, comprising providing a development zone, encompassed by a tensioned deflected flexible imaging member and a transporting member, causing the flexible imaging member to move at a speed of from about 5 cm/sec to about 50 cm/sec, causing the transporting member to move at a speed of from about 6 cm/sec to about 100 cm/sec, said flexible member and said transporting member moving at different speeds, maintaining a distance between the flexible imaging member and the transporting member of from about 0.05 millimeters to about 1.5 millimeters, adding insulating developer particles to the development zone, which particles are comprised of electrically insulating toner particles, and electrically magnetic carrier particles, the flexible imaging member being deflected by the electrically insulating developer particles contained in the development zone, introducing a high electric field in the development zone, wherein the developer particles contained in the development zone are agitated, and the insulating toner particles migrate from one layer of carrier particles to another layer of carrier particles in the development zone, the carrier particles rotating in one direction then subsequently in another direction, whereby toner particles are continuously made available immediately adjacent the flexible imaging member, said process being accomplished in the absence of a magnetic field.

In another embodiment, the present invention is directed to a self agitated development apparatus comprised of a deflected flexible imaging member means moving at a speed of from about 5 cm/sec to about 50 cm/sec, a transporting means moving at a speed of from about 6 cm/sec to about 100 cm/sec, said flexible imaging member means, and said transporting means moving at different speeds, a development zone means containing insulating developer particles and situated between the deflected flexible imaging member means and the transporting member means, said flexible imaging member means being deflected by said developer particles in an arc of from about 10 degrees to about 50 degrees, wherein toner particles transfer from one layer of carrier particles to another layer of carrier particles in the development zone, causing the toner particles to be made continuously available immediately adjacent the flexible imaging member.

In one further embodiment, the present invention is directed to an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating toner particles, and electrically insulating magnetic carrier particles, means for causing the flexible imaging means to move at a speed of from about 5 cm/sec, to about 50 cm/sec; means for causing the transporting means to move at a speed of from about 6 cm/sec to about 100 cm/sec, the means for imaging and the means for transporting moving at different speeds; the means for imaging and the means for transporting having a distance therebetween of from about 0.05 millimeters to about 1.5 millimeters.

In another embodiment, the present invention is directed to an electrostatographic imaging apparatus comprised of an imaging means, a charging means, an exposure means, a development means, a transfer means, and a fixing means, the improvement residing in the development means comprised in operative relationship of a deflected flexible imaging means, and a transporting means, means for causing the transporting means to move at a speed of from about 6 cm/sec to about 100 cm/sec, means for causing the deflected flexible imaging member means to move at a speed of from about 5 cm/sec to about 50 cm/sec, the means for transporting and the means for imaging moving at different speeds, said deflected flexible imaging member means and said transporting means having a distance therebetween of from about 0.05 millimeters to about 1.5 millimeters, the deflection of the flexible imaging member means being caused by electrically insulating developer particles comprised of electrically insulating toner particles, and electrically insulating magnetic carrier particles situated in a development zone encompassed by said deflected flexible imaging member means and said transporting means, said deflection, and the relative movement of the deflected imaging member means and transporting means providing sufficient force so as to cause agitations of said developer particles, means for introducing a high electric field in the development means, wherein said electrically insulating toner particles migrate from said electrically insulating carrier particles, the migration being in the direction of the deflected flexible imaging member means, said migration resulting from the rotation of the electrically insulating carrier particles in one direction, and subsequently in another direction, whereby said electrically insulating toner particles are made continuously available immediately adjacent to the deflected flexible imaging member means.

In another illustrative embodiment, the present invention is directed to an electrostatographic imaging apparatus comprised of an imaging member means, a charging means, an exposure means, a development means, a transfer means, and a fixing means, the improvement residing in the development means comprised of a magnetic member means, containing magnets therein, a deflected flexible imaging means, means for causing movement of the magnetic member means, means for causing movement of the deflected flexible imaging means, the magnetic means and imaging means moving at different speeds, a developer reservoir means containing developer particles comprised of electrically insulating toner particles, and electrically insulating carrier particles, which developer particles are attracted to and maintained on the magnetic means, high magnetic field regions at the entrance and exit region in a development zne encompassed by the magnetic member means, and the deflected flexible imaging member means, and low magnetic field means in the development zone, wherein insulating toner particles are attracted to and deposited onto the deflected flexible imaging member.

One important feature of the present invention, which together with the relative movement of the flexible imaging member, and the transporting member is primarily responsible for the agitation of the developer particles contained in the development zone, resides in the deflected flexible imaging member, this imaging member being deflected in an arc of from about 10 degrees to about 50 degrees, with respect to the transporting member. This deflection is caused primarily by the pressure exerted on the tensioned flexible imaging member by the developer particles contained in the development zone. As a result of the presence of these particles, there is exerted on the tensioned flexible member a pressure of from about 0.01 pounds per squared inch to about 2 pounds per squared inch, and preferably from about 0.1 pounds per squared inch, to about 1 pound per square inch. The pressure exerted on the flexible imaging member is also dependent on the tension and arc radius of the imaging member, thus the pressure P is obtained by dividing the belt tension, T, expressed in a force per unit width of the deflected imaging member, by the arc radius, R of the imaging member, as represented by the equation $P=T/R$.

The flexible imaging member, in contrast to a rigid imaging member, provides a normal or downward force on the developer particles, in perpendicular relationship thereto, and such member also exerts a frictional force in parallel relationship to the deflected flexible imaging member and the transporting member, which frictional force causes agitation of the developer particles. As a result of agitation, the carrier particles move or rotate, allowing toner partiles to migrate from one layer of carrier particles to another layer of carrier particles in the presence of a high electrical field, as indicated hereinbefore. Agitation, and thus rotation of the carrier particles is not accomplished with a rigid imaging member, since such a member exerts substantially no frictional force, and provides a substantially zero normal force. Accordingly, the toner particles will not migrate from one layer of carrier particles to another layer of carrier particles in accordance with the process and apparatus of the present invention. This lack of movement of the toner particles will adversely effect image quality, especially with regard to the development of solid areas.

The frictional force exerted by the flexible imaging member is dependent on a number of factors, including the degree of deflection of the imaging member, the tension in the imaging member, the coefficient of friction between the imaging member, and the insulating developer particles, and the normal force. Thus the frictional force exerted is the product of the coefficient of friction between the flexible imaging member, and the developer particles, and the normal force. The normal force exerted on one developer particle is the product of the normal pressure and the projected area of the developer or carrier particle.

By flexible imaging member as used herein is meant deformed or deflected, such as the photoconductive materials, as described in U.S. Pat. No. 4,265,990. In contrast, a rigid imaging member cannot be easily deflected, such members being stiff or hard, like amorphous selenium which has not been deposited on a flexible substrate. Improved developer agitation in the development zone, and hence better solid area development is obtained when a low magnetic field or substantially no magnetic field is present in such a zone, as the developer does not stiffen, reference for example FIG. 2, but is fluid like under agitation and/or shearing. In accordance with the present invention, the magnetic field is generally less than about 150 gauss, and preferably less than 20 gauss.

The process of the present invention can be employed in electrostatographic systems as illustrated, for example, in FIG. 8. Such a development system, utilizing a flexible deflected imaging member results in a number of advantages over conventional imaging systems, including for example, agitation of the developer particles as described herein, maximum solid area and line development is at its maximum since the charge on the toner particles neutralizes the fields emanating from the image charge, and development, limited by image field neutralization enables the development of low voltage images associated with thin image bearing members, having a thickness of from about 10 to about 30 microns. Furthermore, for a particular image potential, the amount of toner particles deposited on the flexible image bearing member can be, within certin limits, substantially independent of the spacing between the transporting member and the flexible imaging member.

BRIEF DESCRIPTION OF THE DRAWINGS

For a better understanding of the present invention, and further features thereof, reference is made to the following detailed description of various preferred embodiments wherein.

DESCRIPTION OF THE PREFERRED EMBODIMENTS

Figure 1:
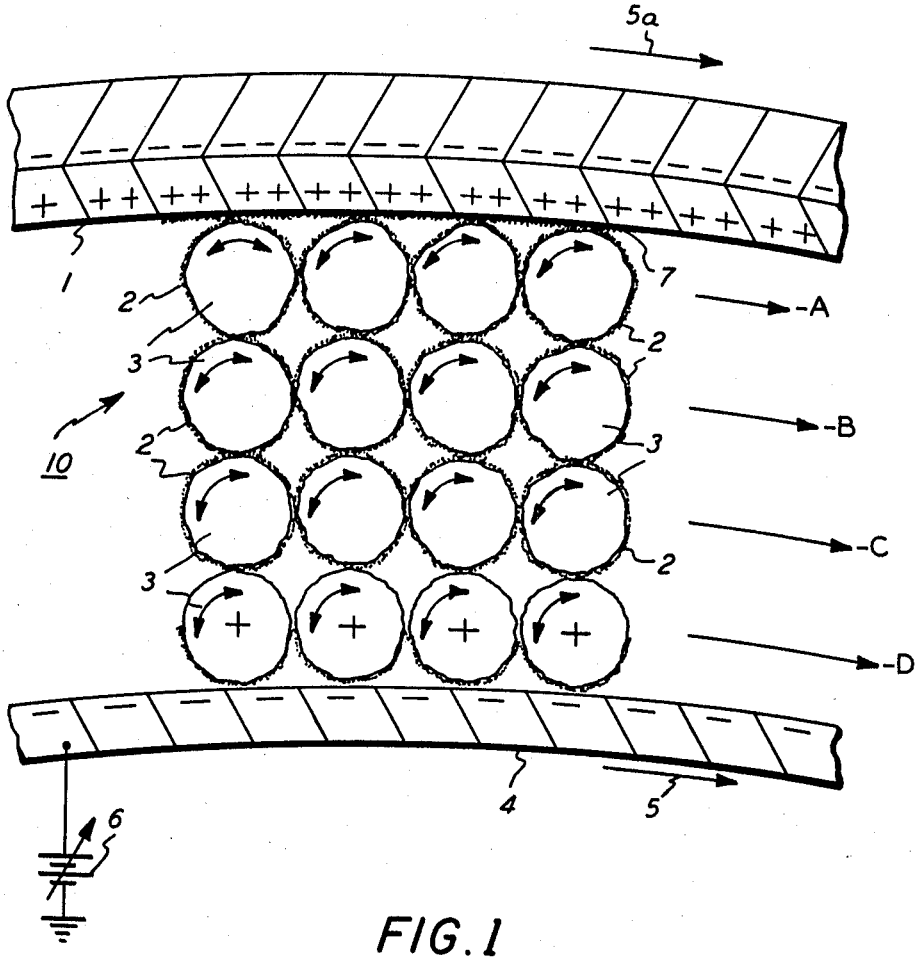
FIG. 1 is a partially schematic cross-sectional view of the development system of the present invention.

Illustrated in FIG. 1 is one embodiment of the development system of the present invention designated 10, which is comprised of a positively charge deflected flexible image member 1, negatively charged toner particles 2, attached to positively charged insulating carrier particles 3, a developer transporting member 4, which can also function as a development electrode, toner depleted layer D, which layer has carrier particles containing a positive charge, this layer having less toner on the carrier than the adjacent carrier layers, C, B, and A, a biased voltage source 6, and a toner developed layer 7. A, B, C, and D designate layers of insulating developer comprised of carrier and toner particles. The deflected flexible image bearing member 1, and developer transporting member 4, in this embodiment are moving in the direction shown by the arrows 5 and 5*a*. Also, in this illustration the transporting member 4 is moving at a more rapid rate of speed than the image bearing member 1, which difference in speed contributes to agitation, and a shearing action in the development zone, thereby causing agitation of the carrier and toner particles, wherein movement of the carrier particles in the presence of an electrical field causes toner particles to transfer from one layer of carrier particles, such as layer B, to another layer of carrier particles, such as layer A. It is not intended, however to be limited to the method of operation shown, nor to be limited to any theory of operation.

The speed of the imaging member 1 can be greater than the speed of the transporting member 4, and movement can be in the opposite direction to that which is shown. Also although the carrier particles 3 are shown in ordered layers, in actual operation they can be distributed randomly in size and position. Further the shape of the carrier particles is not necessarily completely spherical as shown, that is, most carrier particles are non-spherical, with surfaces that can be jagged or textured. In certain embodiments the toner particles 2, can be charged positively, and the carrier particles 3, can be charged negatively. Such a developer would be useful in systems where the deflected flexible image bearing member is charged negatively.

The arrows within the carrier particles 3, indicate that such particles are moving in both directions, first in one direction, for example, slightly to the right than in another direction, slightly to the left. While moving in one direction, then another, the particles are also rotating as more clearly illustrated in FIGS. 1A–1C. This movement or agitation, which results in improved development of images, is caused primarily by the frictional force exerted by the tensioned deflected flexible imaging member, which force would not be exerted by a rigid imaging member, and the relative movement of member 1, and member 4, as indicated herein.

In one method of operation, as indicated hereinbefore, the transporting member 4 is moving at a surface speed which is faster than the speed of the flexible imaging member 1, with the development member and the deflected flexible imaging member moving in the same direction. This relative motion between the member 4, and the deflected flexible imaging member 1, is a contributing factor in causing the developer composition, which is comprised of toner particles 2, and carrier particles 3, to be agitated by a shearing action. When the speed of the flexible image bearing member 1, is less than the speed of the member 4, as shown in FIG. 1, the shearing action causes movement of the carrier particles 3, that is, the carrier particles move in both a clockwise and counterclockwise direction, but on the average tend to move in a counterclockwise direction. The developer agitation and the development electric field allow toner particles 2 adhering to the carrier particles 3 to migrate towards the imaging member 1. The toner particles closest to the deflected flexible imaging member 1 are deposited on the imaging surface, therefore the carrier particles adjacent the imaging surface loose some of the toner particles adhering thereto, which toner particles must be replaced in order to continue to achieve high quality development, and in particular, solid area development. In order for this to occur, toner particles must be transferred from adjacent carrier layers, and this transfer is caused on a continual and constant basis by the shearing action, and an electrical field as indicated hereinbefore. Maximum agitation, which is preferred, is obtained when the magnetic field in the development zone is low, and the developer composition layer contained in the development zone is thin, that is, ranging in thickness of from about 0.05 millimeters to about 1.5 millimeters, and preferably from about 0.4 millimeters to 1.0 millimeters. By low magnetic field it is meant that the field strength is generally less than 150 gauss.

When the deflected flexible image bearing member is positively charged, an electrostatic force directed towards the imaging member acts on all of the negatively charged toner particles 2, which are near the image-carrier interface, and the carrier-carrier interfaces. In the absence of developer agitation, the electrostatic force on the toner particles is not sufficient under normal conditions to overcome toner adhesion, and thus the toner particles are retained on the carrier particles 3. However, when agitation is supplied to the developer, in the presence of an electric field, the toner which remains between two carrier particles can easily transfer when the surfaces are separated by a rolling or a sliding action. The rate of electric field assisted toner migration towards the flexible image member is therefore increased significantly, in comparison, to when agitation is not utilized.

As illustrated in FIG. 1, toner migration results in a toner depleted layer D, and although the toner depleted carrier is positively charged, the effect of this charge layer on the toner motion in the bulk of the developer is small due to the proximity of the layer to the development roll. Thus, both solid area and line development will cease when the charge on the imaging member is essentially neutralized with charged toner. Accordingly, the availability of toner for solid area development is enhanced for a self-agitated two-component insulative development system, and when the electrostatic force and development agitation are sufficient, nearly all of the toner in the developer bulk will deposit on the image bearing member.

The degree of developer agitation can be defined as the product of the shear rate and development time. The average shear rate is equal to the absolute value of the difference in the development roller or electrode velocity, $V_R$, and imaging member velocity, $V_I$, divided by the developer thickness, L, i.e., the average shear rate equals $|V_R - V_I|/L$. The development time is equal to the development zone length, W, divided by the absolute value of the developer roller speed, $|V_R|$; i.e, the development time equals $W/|V_R|$. Thus the degree of developer agitation is equal to $(|V_R - V_I|/L)\times(W/|V_R|)$ or $[|1-1/V|]$ where V is equal to $V_R/V_I$ and is positive or negative when the development roller or electrode moves in the same or opposite direction to the image bearing member respectively. It is assumed that the quantity $|1-1/|V$, is typically near a value of 1 in which case the degree of developer agitation is approximated by W/L, i.e., the ratio of the developer zone length to the developer layer thickness. When the development zone length ranges from 0.5 cm to 5 cm (W) with a preferred length of 1 cm to 2 cm and the developer layer ranges in thickness of from about 0.05 mm to 1.5 mm (L) and preferably about 0.4 mm to 1.0 mm, the developer agitation ranges from 2 to 1,000 and preferably from 10 to 50.

Figure 1C:
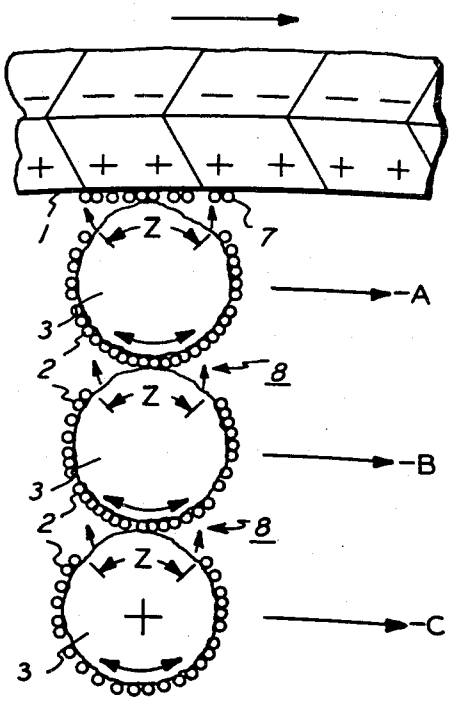
FIGS. 1A, 1B, and 1C illustrate the transfer of toner particles from carrier particles to the imaging member, and the transfer of toner particles from one layer of carrier particles to another layer of carrier particles.
Figure 1B:
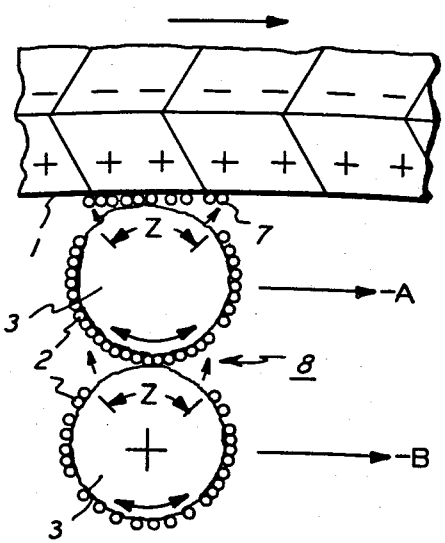
Figure 1A:
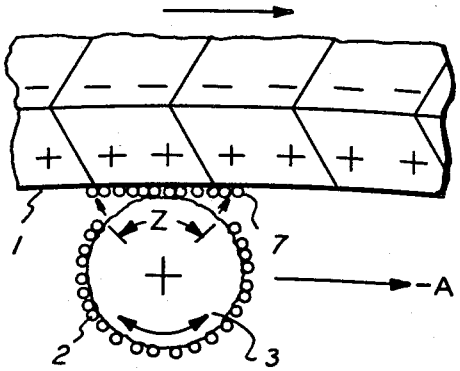
Figure 8:
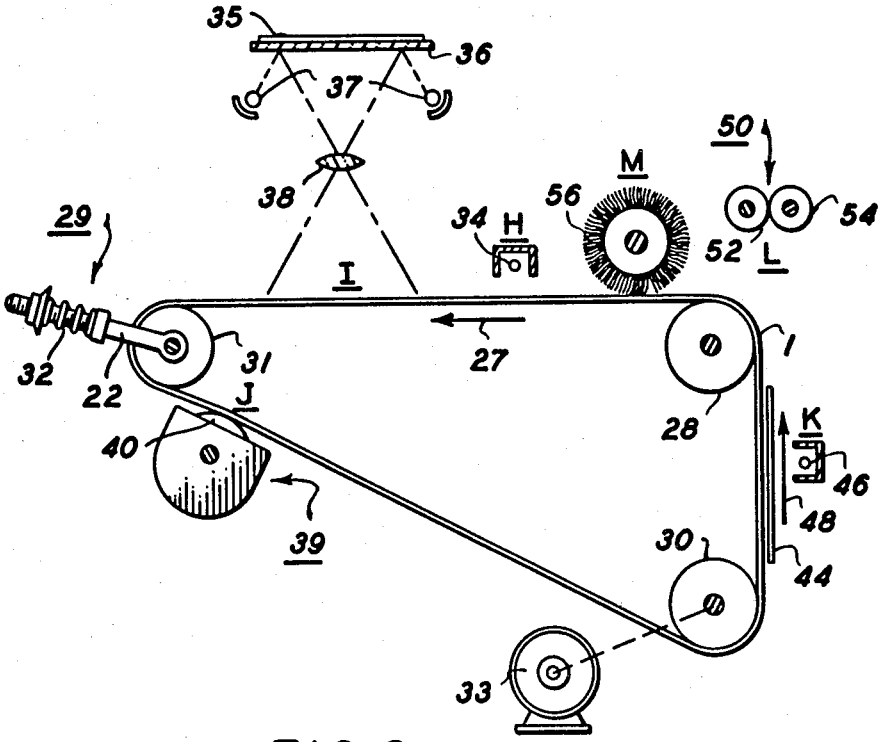
FIG. 8 illustrates the use of the process and apparatus of the present invention in an electrostatographic imaging system.

There is shown in some detail in FIGS. 1A, 1B, and 1C, what is occurring at each of the different layers of developer, designated A, B, and C when employing the imaging process and apparatus of the present invention. In these Figures the numerical and letter designations illustrate the identical components as described with reference to FIG. 1, with the addition that Z represents an area or zone of the carrier particles which have been depleted of toner particles. In FIG. 1A there is illustrated a carrier particles 3, of layer A, which are depleted by toner particles 2, in the area or zone Z; while FIG. 1B, illustrates the transfer of toner particles 2, from carrier particle 3, of layer B, to carrier particle 3, of layer A, resulting in a toner depleted area or zone Z, on carrier particle 3, layer B. In FIG. 1B, 8 represents the interface area between carrier particles, the toner particle 2 transfer from carrier particles 3 of layer C, to carrier particles 3, of layer B, and there results a toner depleted layer or zone Z, on carrier particle 3, layer C. In essence thus the carrier particles of layers A, and B for example, reference FIG. 1B, contact each other, forcing the toner particles 2 between the carrier 3 of layers A and B, to in effect decide what carrier particles to remain with, those of layer A, or those of layer B. In view of the agitation system of the present invention the toner particles move from the carrier particles of layer B, to the carrier particles of layer A, thereby replacing the depleted toner particles on the carrier of layer A in order that such particles will be available to deposit on the imaging member, and cause development. In zone Z electrical fields transfer the toner particles from the carrier beads, for example the carrier beads of layer A, to the imaging member 1. This is caused primarily because of the rocking motion of the carrier beads 3, due to, for example, the frictional force exerted by the tensioned flexible imaging member, which motion further causes a positive charge to be contained on the carrier particles.

More specifically, with reference to FIGS. 1A, 1B and 1C, as the carrier beads rotate in accordance with the present invention, some of the toner particles, 2 on the carrier bead of layer A, transfer to the image bearing member. The toner particles between the carrier particles of layer A, and the carrier particles of layer B, are being acted upon by two opposing forces that from the carrier bead of layer A, and the electrostatic force from the charged imaging member, and that from the carrier bead of layer B. As the force from the carrier bead of layer A, and the imaging member is greater than the force from the carrier bead of layer B, the toner particles become detached form the carrier particles of layer B and attach to the carrier particles of layer A during bead rotation, reference FIG. 1B. This action replaces the toner particles on the carrier particles of layer A but leaves the carrier particles of layer B, with less toner particles. The carrier particle of layer A now has a net electrical charge of zero, whereas the carrier particle of layer B has a net positive electrical charge. The same transfer of toner particles and electrical forces is ilustrated in FIG. 1C, however, an additional layer of carrier particles is shown, namely layer C. Thus the carrier particles of layer B, obtains toner particles from the carrier particles of layer C by the methods described herein. This transfer of toner particles across the different carrier interfaces actually occurs simultaneously throughout the development zone, and as a result toner particles are continually available on the carrier particles immediately adjacent the imaging member, while the carrier particles near the transporting member 4 contain an excess of positive charges, in view of the loss of toner particles to the next layer of carrier particles. After a short period of time, the charge on the carrier particles near the member 4, become neutralized as a result of the high electrical field between the carrier particles and the imaging member. Subsequently, the carrier, and toner particles contained thereon are allowed to pass through a development sump in order that neutral toner particles from a toner dispenser can replenish those toner particles that have been used for developing images, reference FIG. 5. Developer mixing in the developer sump charges the added toner by triboelectric charging.

When the apparatus and process of the present invention are employed in an imaging system, there is provided increased line and increased solid area development, which increases also result in those situations where the developer composition has a rather low toner concentration, in comparison to the developer compositions used in conventional systems. The minimum toner concentration for acceptable solid area development depends on several factors including the ratio of the transporting member speed to imaging member speed, and the degree of developer agitation which depends, for example, on the magnetic field strength, the development zone length, and the spacing between the imaging member and the development roll. Thus for example for a developer containing 0.25 percent by weight of toner, mixed with about 0.75 percent by weight of 100 um diameter steel carrier beads, the solid area development is 0.5 mg/cm$^2$ for a development voltage of 300 volts, a speed ratio of 3, a magnetic field less than 20 gauss, a development zone length of 3.3 cm, and a developer layer thickness of 0.5 mm.

Figure 2:
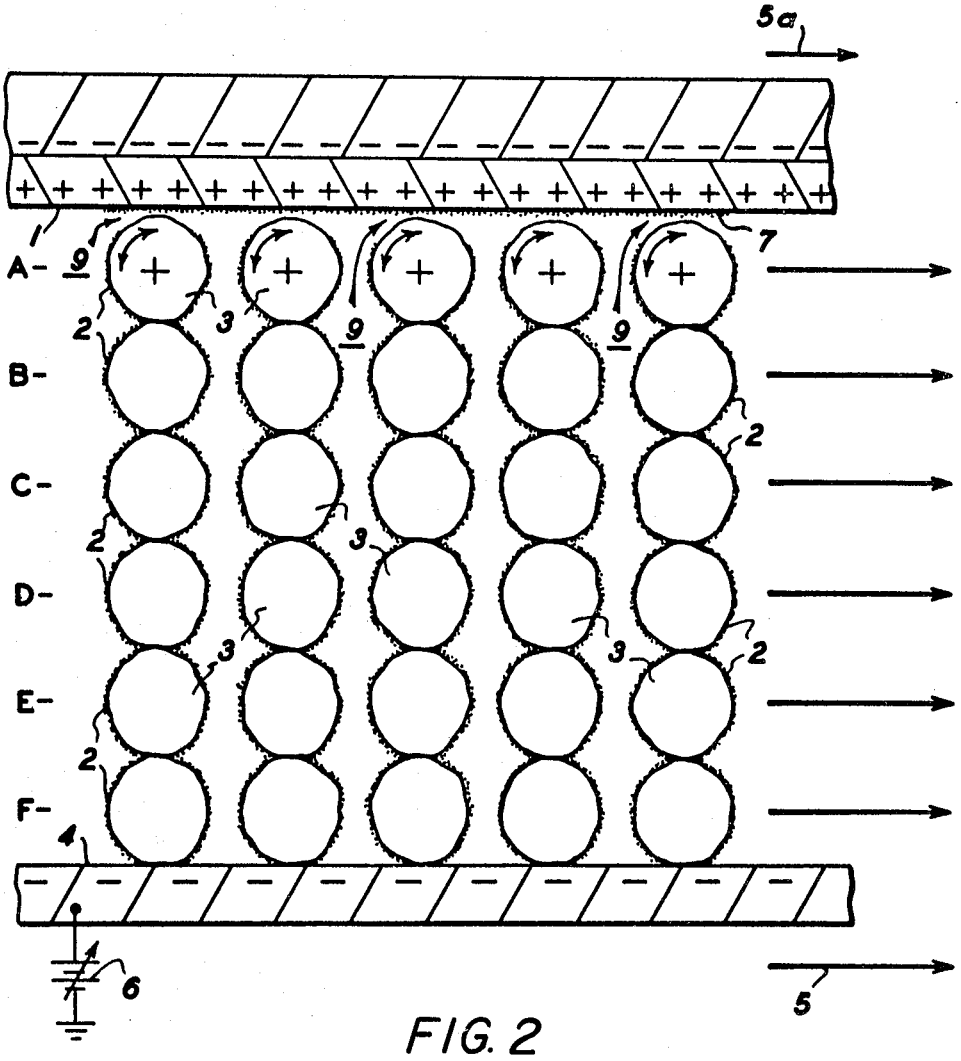
FIG. 2 is a partially schematic cross-sectional view of a conventional development zone wherein two-component insulative developer material is employed.

Illustrated in FIG. 2 is a conventional magnetic brush development system, wherein two component insulative developer material is used, this illustration being provided in order to more clearly point out the advantages of the present invention in some respects over conventional magnetic brush systems. The imaging system of FIG. 2 is comprised of an imaging member 1, negatively charged toner particles 2, positively charged carrier particles 3, development electrode 4, developed toner layer 7, image developer interface 9, and a biased voltage source 6. The developer, that is, toner plus carrier is a two-component insulative developer as described with reference to FIG. 1.

The magnetic field casues the developer to form bead chains or bristles, which are rigid or stiff. Thus developer agitation is limited to a region near the image developer interface 9, and as no agitation in occurring with the other developer particles, transfer of toner from the carrier particles does not result, thereby in effect rendering these other developer particles substantially useless. The charge density on the developer layer A is equal to the negative of the toner charger density 7 on the image bearing member, divided by the ratio of the development electrode speed to imaging member speed. The electric field from the layer of charged developer A is highly effective in reducing the net electric field at the image developer interface. This electric field becomes zero despite the fact that the image charge is not neutralized by toner charge. Solid area development with insulative developers is limited by field collapse even though a sufficient supply of toner might be contained within the first layer of developer A. Furthermore, the solid area development rate decreases when the toner concentration is low and the stiffening of developer by the magnetic field aids in limiting the supply of toner.

Figure 3:
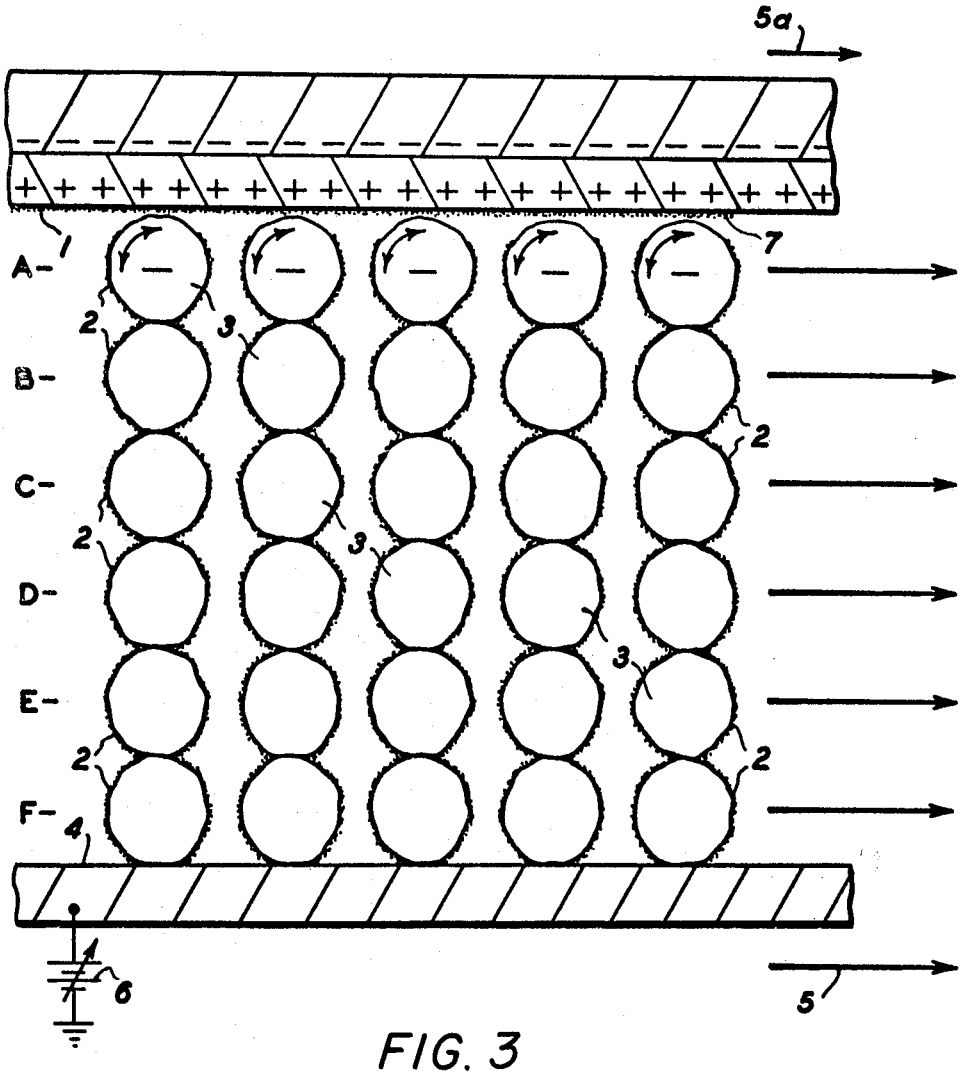
FIG. 3 is a partially schematic cross-sectional view of a conventional development zone wherein conductive developer is employed.

Illustrated in FIG. 3 is an enlarged view of a development zone containing conductive developer. In this Figure, 1 represents the imaging member, 2 represents negatively charged toner particles, 3 represents positively charged carrier particles, 4 is a development electrode, 6 represents the voltage source, 7 represents the developed toner layer. As illustrated in this Figure, the charged image bearing member induces an opposite charge in the layer of developer adjacent to the image. Toner in the developer (within the layer of developer) is inaccessible since the electric field is zero, because the high developer conductivity, and the magnetic field stiffens the developer, and reduces the migration of toner to the image bearing member, that is, toner particles usually do not transfer from one layer of carrier particles, such as B, to another layer of carrier particles such as A, as is the situation with the process and apparatus of the present invention.

Figure 4:
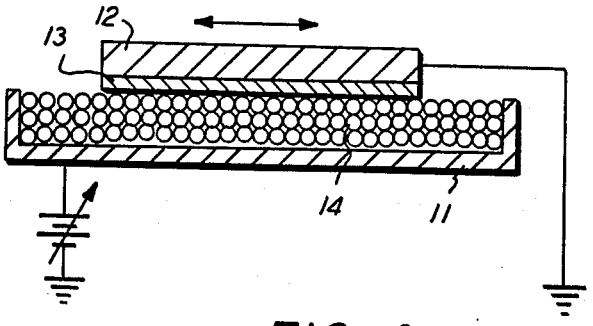
FIG. 4 illustrates an electroded cell for measuring the electrical and development properties of developer.

The conditions which make possible a self-agitated development zone for the improvement of solid area development efficiency is more clearly appreciated by describing measurements on a well defined system. This is illustrated in FIG. 4, which represents an electroded cell for measuring the development properties of developer under controlled conditions. In this Figure, the developer is located in a conducting tray 11, that can be biased with a voltage supply. The upper electrode 12 is coated with an insulating material such as a polyester or photoreceptor layer 13, which is contacted with the developer 14, when a bis is applied to the developer tray 11. Movement of the electrode as indicated by the arrow causes agitation of the developer layer. The toner density developed onto layer 13 is measured by weighing the electrode assembly before, and after subjecting the assembly to an air jet for the purpose of removing toner particles. Using the device shown in FIG. 4, in one embodiment, the toner weight per unit area was 0.23 mg/cm$^2$, which was deposited on an insulating overcoated electrode 12 under the following conditions: a developer bed thickness of 1.5 mm, an applied voltage of 600 volts, and an electrode displacement of 1.9 cm. When a magnetic field of 450 gauss was applied perpendicular to the cell electrodes, the developed toner mass decreased to 0.09 mg/cm$^2$. The larger developed toner mass for magnetic field free conditions is attributed to increased developer agitation. Also, the toner weight developed on the image bearing member is proportional to the ratio of the transporting member and the imaging member speed. Thus when this ratio is 2, and under the conditions stated herein, the toner weight per unit area of 0.46 mg/cm$^2$, would be obtained on the image bearing member. This would result in an acceptable reflective optical density of 1.1.

When similar development data is obtained with a thinner developer layer of 0.5 mm, the solid area development increses since the development electric field is higher. With a 450 gauss magnetic field applied across the developer, the developed toner density is 0.28 mg/cm$^2$ compared to the 0.09 mg/cm$^2$ obtained for a developer thickness of 1.5 millimeters. For magnetic field free conditions, the developed density increases to 0.80 mg/cm$^2$ compared to the 0.23 mg/cm$^2$ obtained when the developer thickness is 1.5 mm. The increase in solid area development for the magnetic field-free case is due to a high agitation of the thin developer layer. The agitation increases the toner supply and displaces the developer net-charge towards the development electrode. Increased solid area development is thus obtained by making the developer layer thin and the development zone magnetic field free.

Self-agitation of the developer in the development zone requires relative motion between the developer transporting member and the deflected flexible image bearing member as indicated herein. When the transporting member is brought into contact with the developer without lateral movement, a small quantity of toner is transferred to the member when a voltage is applied and the member removed, while when the member is displaced while in contact with the developer, increased development occurs since the developer is agitated by the relative motion. The degree of agitation depends, for example, on the magnitude of the relative displacement, which is the product of the relative speed and displacement time.

In a practical development system based on insulative developer a high solid area development rate is achieved when the development zone is thin, magnetic field free, and long, such development systems containing a means of flowing fresh developer through the development zone. Since the developer transporting member is typically moving at a speed faster than the image bearing member, developer will tend to accumulate at the entrance to the magnetic field free zone. To ensure good developer flow, a strong magnetic field at the zone entrance helps to establish proper developer flow through a low magnetic field region. A strong magnetic field at the exit region of the developer zone reduces carrier adhesion to the image bearing member, reference FIG. 5, and prevents scavaging of the toner in solid areas, since as the electrode spacing increases the fields in the solid areas decreases.

Figure 5:
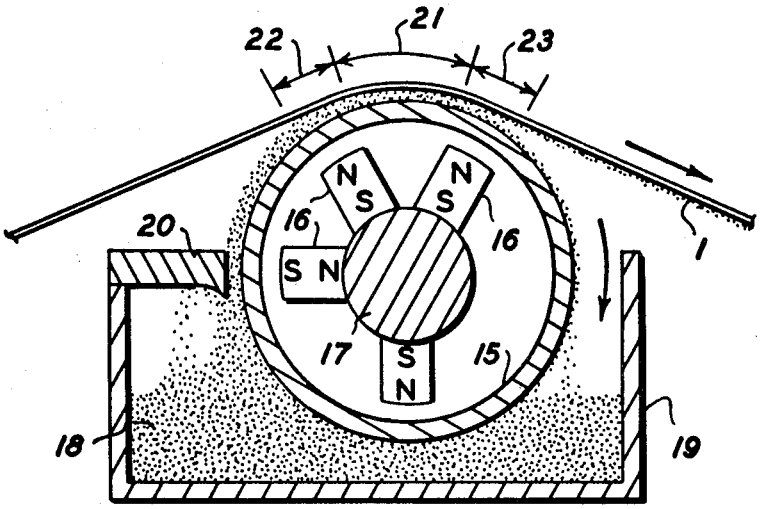
FIG. 5 illustrates a development system of the present invention that incorporates the features of a thin low magnetic field development zone, as well as a high magnetic field at the entrance and exit regions of the development zone.

Illustrated in FIG. 5 is another embodiment of the present invention wherein there is utilized a thin low magnetic field development zone, and a high magnetic field at the entrance and exit regions of the development zone. More specifically, there is illustrated in FIG. 1 a deflected flexible imaging member 1, which imaging member is subjected to a tensioning means, not shown, developing and transporting roller 15, magnets 16 attached to core 17, insulating developer particles 18, comprised of toner particles and carrier particles, developer reservoir 19, metering blade 20, low magnetic field region 21, high magnetic field regions 22 and 23, the arrows indicating the direction of movement. Agitation of the carrier particles and movement of the toner particles as indicated hereinbefore occurs in a zone defined by the deflected imaging member 1 and roller 15. In operation, the developer particles 19, are intitially transported on roller 15, subsequent to metering by blade 20, which metering controls the thickness of the developer layer, the particles maintaining their position on roller 15 in view of the high magnetic fields 22 and 23, and the toner particles being caused to migrate to the imaging member 1, in low magnetic field region 21.

Developer agitation is caused by the frictional force exerted by the flexible imaging member and the relative movement between the imaging member and magnetic roller as indicated herein, while the thickness of the developer layer, usually one layer of developer particles establishes the distance between the imaging member and the magnetic roller. Steel shunting inside the roller 15 is utilized to reduce the magnetic field between the magnetic poles at the entrance and exit regions. For achievement of good developer flow, the ratio, V of roller 15 velocity to flexible imaging member velocity, is greater than zero and less than $-1$. Inadequate developer flow usually results when V is greater than $-1$, that is $-\frac{1}{2}$ and the like.

The magnetic field within the central area of the development zone is generally less than 150 gauss and preferably less than 20 gauss, while the magnetic field at the entrance and exit regions of the development zone is radially directed and is typically from about 300 to about 600 gauss. The magnetic field profile is obtained by a suitable choice of permanent magnets and steel shunting inside the roller 15 can provide magnetic field shaping at the surface of this roller. Also the magnetic poles are of like polarity in the embodiment illustrated.

A thin layer of developer is applied to the roller 15 with the aid of a metering blade 20, closely spaced from the development roll. The uniformity of the developer thickness is determined by the runout in the roll and the straightness of the metering blade. When the metering blade is positioned where the magnetic field is in a radial direction (perpendicular to the development roll), the developer layer thickness is approximately equal to the metering blade gap setting. If the metering blade is located where the magnetic field is tangential to the roll, the developer layer thickness is approximately 0.4 of the metering gap setting. A reduced developer layer thickness is obtained because the developer bead chains tangential to the development roll are magnetically attracted to the mass of developer peeled away by the metering blade. Developer matering in a tangential magnetic field enables one to obtain a thin developer layer of approximately 0.5 mm when the metering gap is set at 1.2 millimeters.

Figure 6:
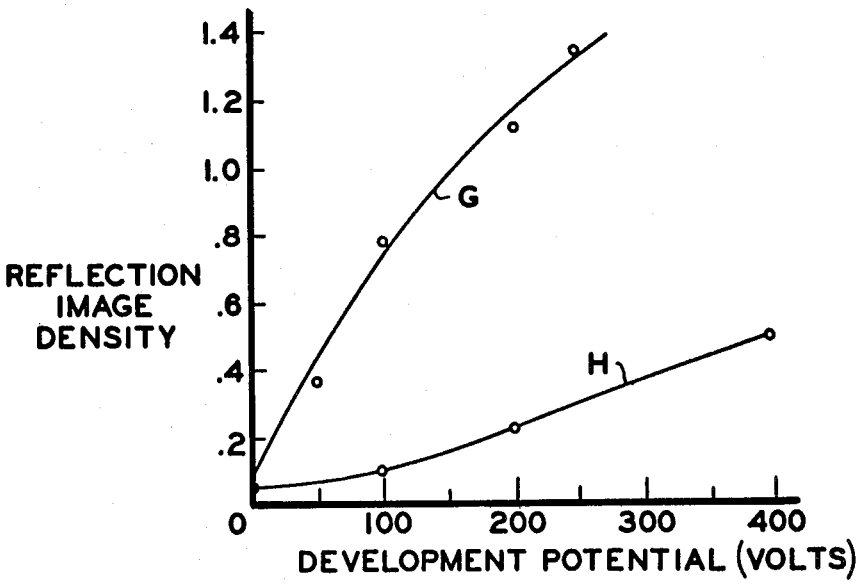
FIG. 6 illustrates a comparison between (1) the solid area development characteristic of the self-agitated development system of the present invention as illustrated in FIGS. 1 and 5; and (2) the development characteristics of a conventional magnetic brush development system as illustrated in FIG. 2.

FIG. 6 is a graph of data comprising the solid area development characteristics of the self-agitated development system depicted in FIG. 5, curve G; with the characteristics of a conventional magnetic brush system, curve H. As illustrated, line curve G, reveals an increased or higher optical density, as compared to line curve H. Therefore, increased toner deposition on the flexible imaging member results, curve G.

With specific reference to FIG. 6, line G represents data obtained for the development system of the present invention with a 0.4 millimeter gap, (distance between the imaging member, and the transporting member) while curve H represents data obtained with a conventional magnetic brush system, 1.5 millimeter gap. A developer composition comprised of toner particles, in a 2.7 percent concentration consisting of a styrene n-butylmethacrylate copolymer and carbon black, and carrier particles containing a flouropolymer coating on a ferrite core was employed in both systems; and the speed ratio of the imaging member to the transport member was two for each system. Increased toner deposition, and thus increased development with the system of the present invention, curve G, is attributed to, the utilization of a deflected flexible imaging member, a thin developer layer (0.4 mm), a low magnetic field (20 gauss) and long development zone (3 cm). In the conventional system, the magnetic field is 500 gauss, and the development zone length is 0.5 cm. Thus, for example, at a development potential of 200 volts, the reflection image density, curve G is greater than 1, indicating excellent toner deposition and superior development, while for conventional systems at 200 volts the reflection image density, curve H, is less than 0.2.

For the self-agitated development system described herein, the spacing between the transporting or development member and the deflected flexible image bearing member is determined primarily by the developer layer thickness, that is, the amount of toner and carrier particles contained in the developer zone. As indicated this spacing typically ranges from about 0.05 millimeters to about 1.5 millimeters and preferably is from about 0.4 millimeters to about 1.0 millimeters.

The length of the development zone depends , for example, on the configuration of the image bearing member, and the configuration of the developer transport member. In a preferred embodiment, the image bearing member is a belt partially wrapped or arced around a development roll, which roll has a diameter which is typically from about 3.8 cm to about 6.4 cm. In this configuration, the length of the development zone, and contact between the developer and flexible imaging member ranges from about 0.5 cm to about 5 cm, with a preferred length being from about 1 cm to about 2 cm. Idler rolls positioned against the backside of the belt can be used to alter the belt path.

Figure 7:
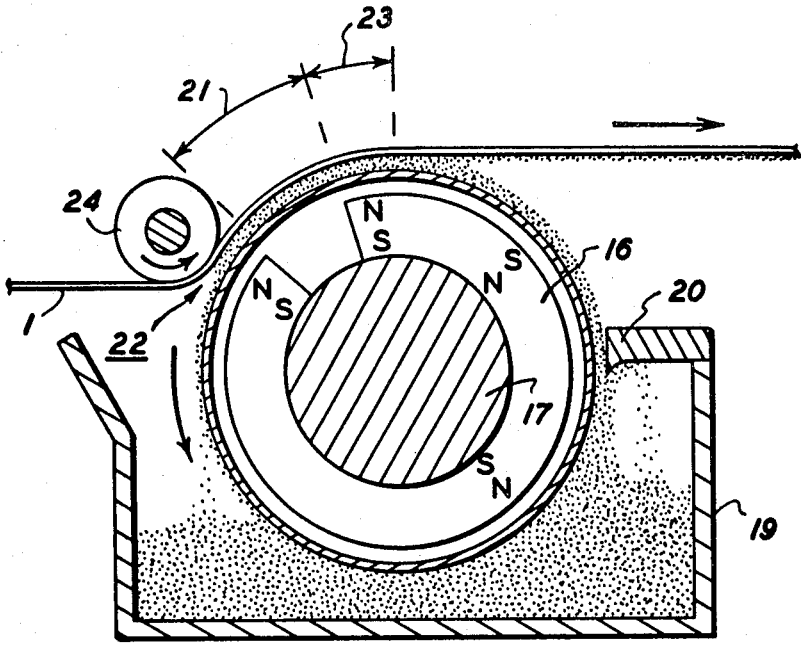
FIG. 7 illustrates another preferred embodiment of a selfagitated development system that incorporates an idler roll.

FIG. 7 illustrates one example of a self-agitated development system design that incorporates an idler roll. Although not shown more than one idler roll can be used. The purpose of the idler roll, or rolls, is to allow freedom in the position of the zones, such as the paper transport zone for example in an electrostatographic or similar apparatus. In this Figure the numerical designations 15, 16, 17, 19, 21, 22, and 23 represent the same components as described in FIG. 5, while the idler roll is designated 24. It is understood that a second idler roll could be placed near region 23 to alter the path of the imaging member without causing a change in the operation of the development system. The system shown in FIG. 7 is operating in a mode in which the development roller and imaging member are moving in opposite directions.

The apparatus and process of the present invention is useful in many systems including electronic printers, and electrostatographic copying machines, such as those employing xerographic apparatus well known in the art. In FIG. 8 there is illustrated an electrophotographic printing machine employing a deflected flexible imaging member 1 having a photoconductive surface deposited on a conductive substrate, such as aluminized Mylar, which is electrically grounded. The imaging member 1, or the photoconductive surface can be comprised of numerous suitable materials, as described herein for example, however, for this illustration the photoconductive material is comprised of a photogenerating layer of trigonal selenium, or vanadyl phthalocyanine, overcoated with a transport layer containing small molecules of N,N,N',N'-tetraphenyl-[1,1'-biphenyl] 4,4'-diamine, or similar diamines dispersed in a polycarbonate. Deflected flexible imaging member 1 moves in the direction of arrow 27 to advance successive portions of the photoconductive surface sequentially through the various processing stations disposed about the path of movement thereof. The imaging member is entrained about a sheet-stripping roller 28, tensioning means 29, and drive roller 30. Tensioning system 29 includes a roller 31 having flanges on opposite sides thereof to define a path through which member 1 moves. Roller 31 is mounted on each end of guides attached to the springs. Spring 32 is tensioned such that roller 31 presses against the imaging belt member 1. In this way, member 1 is placed under the desired tension. The level of tension is relatively low permitting member 1 to be relatively easily deformed. With continued reference to FIG. 8, drive roller 30 is mounted rotatably and in engagement with member 1. Motor 33 rotates roller 30 to advance member 1 in the direction of arrow 27. Roller 30 is coupled to motor 33 by suitable means such as a belt drive. Sheet-stripping roller 28 is freely rotatable so as to readily permit member 1 to move in the direction of arrow 27 with a minimum of friction.

Initially, a portion of imaging member 1 passes through charging station H. At charging station H, a corona generating device, indicated generally by the reference numeral 34, charges the photoconductive surface of imaging member 1 to a relatively high, substantially uniform potential.

The charged portion of the photoconductive surface is then advanced through exposure station 1. An original document 35 is positioned face down upon transparent platen 36. Lamps 37 flash light rays onto original document 35. The light rays reflected from original document 35 are transmitted through lens 38 forming a light image thereof. Lens 38 focuses the light image onto the charged portion of the photoconductive surface to selectively dissipate the charge thereon. This records an electrostatic latent image on the photoconductive surface which corresponds to the informational areas contained within original document 35.

Thereafter, imaging member 1 advances the electrostatic latent image recorded on the photoconductive surface to development station J. At development station J, a self-agitated development system, indicated generally by the reference numeral 39, advances a developer material into contact with the electrostatic latent image. The self-agitated development system 39 includes a developer roller 40 which transports a layer of developer material comprising magnetic carrier particles and toner particles into contact with the deflected flexible imaging member 1. As shown, developer roller 40 is positioned such that the brush of developer material deforms imaging member 1 in an arc, such that member 1 conforms at least partially, to the configuration of the developer material. The electrostatic latent image attracts the toner particles from the carrier granules forming a toner powder image on the photoconductive surface of member 1. The development roller 40 returns the developer material to the sump of development system 39 for subsequent re-use. The detailed structure of the development system 39 has been described herein, reference FIGS. 1, 1A, 1B, 1C, 5 and 7.

Imaging member 1 then advances the toner powder image to transfer station K. At transfer station K, a sheet of support material 44 is moved into contact with the toner powder image. The sheet of support material 44 is advanced to transfer station K by a sheet feeding apparatus (not shown). Preferably, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of member 1 in a timed sequence so that the toner powder image developed thereon contacts the advancing sheet of support material at transfer station K.

Transfer station K includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station L.

Fusing station L includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

After the sheet of support material is separated from the photoconductive surface or imaging member 1 some residual particles remain adhering thereto, which particles are removed from the photoconductive surface to cleaning station M. Cleaning station L includes a rotatably mounted fibrous brush 56 in contact with the photoconductive surface. The particles are cleaned from the photoconductive surface by the rotation of brush 56 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Illustrative examples of the deflected flexible image bearing member 1, include inorganic and organic photoreceptor materials. Examples of inorganic materials, which are deposited on a flexible substrate, include amorphous selenium, selenium alloys, including alloys of selenium-tellurium, selenium arsenic, selenium antimony, selenium-tellurium-arsenic, cadmium sulfide, zinc oxide, and the like. Examples of flexible organic materials include layered organic photoreceptors, such as those containing as an injecting contact, carbon dispersed in a polymer, overcoated with a transport layer, which in turn is overcoated with a generating layer, and finally an overcoating of an insulating organic resin, such as those described in U.S. Pat. No. 4,251,612, incorporated herein by reference, and overcoated photoreceptor devices comprised of a substrate, a transport layer and a generating layer such as those described in U.S. Pat. No. 4,265,990.

Examples of other flexible imaging member materials include organic photoreceptor materials such as polyvinyl carbazole, 4-dimethylamino-benzylidene, benzhydrazide; 2-benzylidene-amino-carbazole, 2-benzylidene-amino-carbazole, polyvinyl carbazole; (2-nitro-benzylidene)-p-bromo-aniline; 2,4-diphenyl quinazoline;

1,2,4-triazine; 1,5-diphenyl-3-methyl pyrazoline 2-(4'-dimethyl-amino phenyl) benzoxazole; 3amino-carbazole; polyvinylcabazole-trinitrofluorenone charge transfer complex; phthalocyanines, mixtures thereof, and the like.

Illustrative examples of the transporting member 4 include virtually any conducting material made for this purpose, such as stainless steel, aluminum and the like. Texture in member 4 provides traction necessary for good developer transport from the developer sump and through the development zone. The development roll texture is obtained by one of several methods involving flame-spray treating, etching, knurling, and the like.

The developer material is comprised of an electrically insulating toner resin, colorant or pigment, and a suitable insulating magnetic carrier material. By insulating as used throughout the description, is meant non-conducting, that is, for example charge does not tend to flow from the transport member to the ends of the carrier particles nearest the image bearing member within a time that is less than the development time. Considering the range of the development zone length, 0.5 centimeters to 5 centimeters, and the speed of the transporting member, the range of development times is calculated as follows:

The Longest Development Time $$T = \frac{5 \text{ cm (maximum development zone length)}}{6 \text{ cm/sec (minimum transport member speed)}} = 0.83 \text{ seconds}$$

The Shortest Development Time $$T' = \frac{0.5 \text{ cm (minimum development zone length)}}{100 \text{ cm/sec (maximum transport member speed)}} = 5 \cdot 10^{-3} \text{ seconds}$$

While any suitable material may be employed as the toner resin in the system of the present invention, typical of such resins are polyamides, epoxies, polyurethanes, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene, p-chlorostyrene vinyl naphthalene, ethylenecally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl arylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, arylamide, vinyl esters such as vinyl methyl ether, vinyl isobutyl ether, vinyl ethyl ether, and the like; vinyl ketones such as vinyl methyl ketone, vinyl hexyl ketone, methyl isopropenylketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred since greater image definition and density is obtained with their use. The sytrene resin employed may be a homopolymer of styrene or styrene homologs of copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more resins if desired, preferably other vinyl resins which insure good triboelectric properties and uniform resistance against physical degradation. However, non-vinyl type thermoplastic resins may also be employed including resin modified phenol-formaldehyde resins, oil modified epoxy resins, polyurethane resins, cellulosic resins, polyether resins and mixtures thereof.

Also esterification products of a dicarboxylic acid and a diol comprising a diphenol may be used as a preferred resin material for the toner composition of the present invention. These materials are illustrated in U.S. Pat. No. 3,655,374, totally incorporated herein by reference, the diphenol reactant being of the formula as shown in column 4, line 5 of this patent and the dicarboxylic acid being of the formula as shown in column 6 of the above patent.

The toner resin particles can vary in diameter, but generally range from about 5 microns to about 30 microns in diameter, and preferably from about 10 microns to about 20 microns.

Various suitable pigments or dyes may be employed as the colorant for the toner particles, such materials being well known and including for example, carbon black, nigrosine dye, aniline blue, calco oil blue, phthalocyanine blue, and mixtures thereof. The pigment or dye should be present in sufficient quantity to render it highly colored so that it will form a clearly visible image on the recording member. For example, where conventional xerographic copies of documents are desired, the toner may comprise a black pigment such as carbon black or a black. Preferably the pigment is employed in amounts from about 3 percent to about 20 percent by weight based on the total weight of toner, however, if the toner color employed is a dye, substantially smaller quantities of the color may be used.

Also there can be incorporated in the toner (resin plus colorant) various charge control agents primarily for the purpose of imparting a positive charge to the toner resin. Examples of charge control agents include quaternary ammonium compounds as described in U.S. Pat. No. 3,970,571, and alkyl pyridinium halides such as cetyl pyridinium chloride.

Numerous suitable electrically insulating magnetic carrier particles can be employed as long as such particles are capable of triboelectrically obtaining a charge of opposite polarity to that of the toner particles. In the present invention in one embodiment that would be a negative polarity, to that of the toner particles which are positively charged so that the toner particles will adhere to and surround the carrier particles. Thus, the carriers can be selected so that the toner particles acquire a charge of a positive polarity and include materials such as steel, nickel, iron ferrites, magnetites and the like. The carriers can be used with or without a coating, examples of coatings including fluoropolymers such as polyvinylidene fluoride, methyl terpolymers and the like. Also nickel berry carriers as described in U.S. Pat. Nos. 3,847,604 and 3,767,598 can be employed, these carriers being nodular carrier beads of nickel characterized by surface of reoccuring recesses and protrusions providing particles with a relatively large external area. Preferably the carrier particles, or their cores are of materials that are sufficiently conducting to dissipate net charge accumulation from the development process such as for example steel shot carriers. The diameter of the coated carrier particle ranges from about 50 to about 1,000 microns, thus allowing the carrier to possess sufficient density and inertia to avoid adherence to the electrostatic images during the development process.

While preferred embodiments have been specified for the speed of movement of the members involved, it is to be appreciated that these members may have speeds outside the ranges disclosed, providing the objectives of the present invention are accomplished. Thus, for example, the flexible imging member can be caused to move at a speed of from about 5 cm/sec to about 80 cm/sec, and the transporting member can be caused to move at a speed of from about 6 cm/sec to about 180 cm/sec.

Other modifications of the present invention may occur to those skilled in the art based upon a reading of the present disclosure. These are intended to be included within the scope of the present invention.

What is claimed is:

1. An electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating toner particles, and electrically insulating magnetic carrier particles, means for causing the flexible imaging means to move at a speed of from about 5 cm/sec, to about 50 cm/sec, means for causing the transporting means to move at a speed of from about 6 cm/sec to about 100 cm/sec, the means for imaging and the means for transporting moving at different speeds; and the means for imaging and the means for transporting having a distance therebetween of from about 0.05 millimeters to about 1.5 millimeters.

2. An electrostatographic imaging apparatus in accordance with claim 1 wherein there is further included in the development means, means for introducing a high electric field.

3. An electrostatographic imaging apparatus in accordance with claim 2 wherein the electrically insulating toner particles migrate from the electrically insulating magnetic particles in the direction of the deflected flexible imaging member, said migration resulting from the rotation of the electrically insulating carrier particles in one direction, and subsequently in another direction, whereby the electrically insulating toner particles are made continuously available immediately adjacent to the deflected flexible imaging means.

4. An electrostatographic imaging apparatus in accordance with claim 2 wherein said flexible imaging member means is deflected in an arc of from about 10 degrees to about 50 degrees.

5. An electrostatographic imaging apparatus in accordance with claim 2 wherein the tensioned deflected flexible imaging member and transporting member are moving in the same direction or in an opposite direction.

6. An electrostatographic imaging apparatus in accordance with claim 2 wherein the distance between the deflected flexible imaging member means and the transporting member means ranges from about 0.04 millimeters to about 1 millimeter, and the development zone length ranges from about 1 centimeter to about 2 centimeters.

7. An electrostatographic imaging apparatus in accordance with claim 2 wherein the electrically insulating toner particles contained in the developer composition are charged positively, and the electrically insulating magnetic carrier particles contained in the developer composition are charged negatively, and the flexible imaging member is charged negatively.

8. An electrostatographic imaging apparatus in accordance with claim 7 wherein there is added thereto a charge control additive for the purpose of imparting a positive charge to the toner resin.

9. An electrostatographic imaging apparatus in accordance with claim 8 wherein the charge control additive is a quaternary ammonium compound or an alkyl pyridinium halide.

10. An electrostatographic imaging apparatus in accordance with claim 2 wherein the deflected flexible imaging member is comprised of a photoresponsive member containing a substrate, a hole injecting layer, a hole transport layer, a charge generating layer, and an overcoated layer of an electrically insulating organic resin.

11. An electrostatographic imaging appartus in accordance with claim 2 wherein the deflected flexible imaging member contains a substrate, a charge generating layer, and a hole transport layer.

12. An electrostatographic imaging apparatus comprised in operative relationship of a tensioned deflected flexible imaging member, a transporting roller means containing magnets therein attached to the transporting roller core, said roller containing thereon insulative developer particles comprised of electrically insulating toner particles, and electrically insulating magnetic carrier particles, whereby toner particles are transferred to the deflected flexible imaging member with the further provision that there is provided a low magnetic field means in a development zone encompassed by the deflected flexible imaging member, and the transporting roller means, and high magnetic fields at the entrance and exit regions of said development zone.

13. An electrostatographic imaging apparatus in accordance with claim 12, wherein the tensioned deflected flexible imaging members is in an arc of from about 10 degrees to about 50 degrees.

14. An electrostatographic imaging apparatus in accordance with claim 12 wherein the deflected flexible imaging member is comprised of a substrate, a hole injecting layer, a hole transport layer, a charge generating layer, and an overcoated layer of an electrically insulating organic resin.

15. An electrostatographic imaging apparatus in accordance with claim 12 wherein the deflected flexible imaging member is comprised of a substrate, a hole transport layer, and a charge generating layer.

16. An electrostatographic imaging apparatus in accordance with claim 12 wherein there is maintained a distance of from about 0.05 millimeters to about 1.5 millimeters between the deflected flexible imaging member and the transporting roller.

17. An electrostatographic imaging apparatus in accordance with claim 1 wherein there is further included an idler roller.

18. An electrostatographic imaging method which comprises forming an electrostatic image on a tensioned deflected flexible imaging member contained in an electrostatographic imaging apparatus comprised of an imaging means, a charging means, an exposure means, a development means, a transfer means, and a fixing means, the improvement residing in the development means comprised in operative relationship of a deflected flexible imaging means, and a transporting means, means for causing the transporting means to move at a speed of from about 6 cm/sec to about 100 cm/sec, means for causing the deflected flexible imaging member means to move at a speed of from about 5 cm/sec to about 50 cm/sec, the means for transporting and the means for imaging moving at different speeds, said deflected flexible imaging member means and said transporting means having a distance therebetween of from about 0.05 millimeters to about 1.5 millimeters, the deflection of the flexible imaging member means caused by electrically insulating developer particles comprised of electrically insulating toner particles, and electrically insulating magnetic carrier particles situated in a development zone encompassed by said deflected flexible imaging member means, and said transporting means, said deflection and said relative movement of the deflected flexible imaging member means and transporting means providing sufficient force so as to cause agitation of said developer particles, means for introducing a high electric field into the development means, wherein said electrically insulating toner particles migrate from said electrically insulating magnetic carrier particles, the migration being in the direction of the deflected flexible imaging member means, said migration resulting from the rotation of the electrically insulating carrier particles in one direction and subsequently in another direction, whereby said electrically insulator toner particles are made continuously available immediately adjacent the deflected flexible imaging member means, and wherein agitation and the presence of an electrical field in a development zone causes toner particles to migrate and deposit on the electrostatic latent image, followed by transferring the developed image to a substrate, and permanently fixing the image thereto.

19. A method of imaging in accordance with claim 18 wherein the deflected flexible imaging member is in an arc of from about 10 degrees to about 50 degrees.

20. An electrostatographic imaging member in accordance with claim 12 wherein the deflected flexible imaging member is comprised of a substrate, a hole injecting layer, a hole transport layer, a charge generating layer, and an overcoating layer of an insulating organic resin.

21. An electrostatographic imaging method in accordance with claim 18 wherein deflected flexible imaging member is comprised of a substrate, a hole transport layer, and a charge generating layer.

22. An electrosatographic imaging method in accordance with claim 18 wherein the deflected flexible imaging member and transporting member are moving in the same direction, or said members are moving in opposite directions.

23. An electrostatographic imaging method in accordance with claim 18 wherein the toner particles are comprised of a styrene butylmethacrylate copolymer resin, and carbon black.

24. An electrostatographic imaging method in accordance with claim 18 wherein there is added to the developer composition a charge enhancing additive.

25. An electrostatographic imaging method in accordance with claim 24 wherein the charge enhancing additive is a quaternary ammonium compound, or an alkyl pyridinium halide.

* * * * *